United States Patent [19]

Kindred

[11] Patent Number: 4,815,961

[45] Date of Patent: Mar. 28, 1989

[54] MODELING COMPOUND FORMING TOY

[76] Inventor: William B. Kindred, 14659 Horger, Allen Park, Mich. 48101

[21] Appl. No.: 142,727

[22] Filed: Jan. 11, 1988

[51] Int. Cl.[4] ..... B29C 45/02

[52] U.S. Cl. ..... 425/544; 425/376.1; 425/DIG. 57; 425/DIG. 228

[58] Field of Search ..... 425/256, 376.1, 544, 425/DIG. 57, DIG. 228, DIG. 243; 446/72, 86, 424, 483

[56] References Cited

U.S. PATENT DOCUMENTS

| | | | |
|---|---|---|---|
| 3,590,749 | 7/1971 | Burns et al. | 425/DIG. 57 |
| 3,685,936 | 8/1972 | Meth et al. | 425/DIG. 57 |
| 4,583,934 | 4/1986 | Hata et al. | 425/376.1 |
| 4,623,319 | 11/1986 | Zaruba et al. | 425/DIG. 57 |

*Primary Examiner*—Jay H. Woo
*Assistant Examiner*—C. Scott Bushey
*Attorney, Agent, or Firm*—Brooks & Kushman

[57] ABSTRACT

A toy (10) for forming modeling compound includes a base (12), a turntable (16) rotatable on the base, a receptacle (22) on the turntable for receiving the modeling compound, a ram member (34), and a rotary actuator (44) for driving a peripheral drive gear (20) of the turntable to provide screw actuated movement of the ram member for forcing modeling compound from the receptacle (22) through a forming component (32) for forming. In one embodiment, the rotary actuator (44) includes a hand operated crank (74) and in another embodiment is power operated and includes an electric motor (102) and gear drivetrain (108) for providing the screw operated movement of the ram member for the forming. The forming component (32) may be embodied by an extruder (162) or a mold (170) to provide either extrusion or mold forming of the modeling compound.

13 Claims, 3 Drawing Sheets

MODELING COMPOUND FORMING TOY

TECHNICAL FIELD

This invention relates to a toy for forming modeling compound such as clay or the like.

BACKGROUND ART

Children have played with clay and other types of modeling compound for many years in the past. However, conventional modeling compound that is sufficiently resistant to deformation so as to maintain its shape after forming presents difficulty for children who do not always have sufficient strength to deform the modeling compound as desired. This is a particular problem that has made it difficult to form modeling compound by extrusion or molding of the modeling compound.

DISCLOSURE OF INVENTION

An object of the present invention is to provide an improved toy that enables children to form modeling compound such as clay or the like during play.

In carrying out the above object and other objects of the invention, a modeling compound forming toy constructed in accordance with the present invention includes a base having a central ram slide. A turntable of the toy is rotatably supported on the base and has a central threaded portion aligned with the ram slide of the base. The turntable also has a peripheral drive gear that extends around its central threaded portion.

A receptacle of the toy has a first end for providing mounting thereof on the turntable. This receptacle has a hollow interior for receiving modeling compound to be formed and has a second end for supporting a component for forming the modeling compound.

A ram member of the toy has a ram and a threaded slide rod projecting from the ram. The ram is received within the receptacle whose interior receives the modeling compound, and the threaded slide rod is slidably received within the central ram slide of the base and is threaded through the central threaded portion of the turntable.

Operation of the toy is provided by a rotary actuator for driving the drive gear of the turntable to provide rotation thereof and screw actuated movement of the ram. Such movement of the ram under the operation of the rotary actuator forces the modeling compound out of the receptacle for forming of the modeling compound.

In the preferred construction, the base, the turntable, the receptacle, and the ram member of the toy are manufactured as plastic injection moldings. This preferred construction also has the plastic injection molded turntable and receptacle made separate from each other and provided with retainers that permit securement of the receptacle to the turntable for use. These retainers are preferably constructed as arcuate tabs that are engaged by rotation of the receptacle relative to the turntable for securement. Also, the injection molded plastic ram member has its ram shaped as a round disc from which the threaded slide rod projects at a central location, and the threaded slide rod has a distal locking end remote from the ram. A locking clip associated with the ram member is also preferably injection molded from plastic and is locked to the locking end of the slide rod to limit the screw actuated movement of the ram member with respect to the turntable.

In one embodiment, the rotary actuator includes a rotary hand crank and a pinion gear rotated by the hand crank. The base has a bearing for rotatably supporting the pinion gear which is meshed with the peripheral drive gear of the turntable to provide rotation thereof upon manually actuated rotation of the hand crank. Such rotation thus moves the ram member by a screw actuation in order to provide the forming of the modeling compound with a mechanical advantage that enables children to manually perform the forming. The pinion gear of this manually operated rotary actuator includes a central pin and the bearing includes an annular bearing ring on the pin. This pin, the bearing ring, and a screw cooperate to provide rotatable support of the pinion gear in meshing engagement with the drive gear of the turntable such that the manually actuated rotation of the hand crank provides the forming operation of the toy.

In another embodiment, the rotary actuator of the forming toy includes: a housing an electric motor supported by the housing, a battery clip assembly for supporting at least one battery for energizing the motor, a switch for controlling the motor operation, and a gear drivetrain having an input driven by the motor and an output that drives the peripheral drive gear of the turntable. The housing of this electric motor rotary actuator includes a cover and a chassis as well as including a motor mount that supports the electric motor. The cover and chassis of the housing and the motor mount are each made as a separate plastic injection molding, and a pair of screws secure the cover and chassis of the housing and the motor mount to each other in an assembled relationship.

The modeling compound forming toy is disclosed in one version as including an extruder that functions as the component for forming the modeling compound with the extruder secured to the second end of the receptacle. An opening of the extruder is provided such that the modeling compound is extruded upon operation of the rotary actuator either by the hand crank or electric motor actuation. A retaining ring is also disclosed as being utilized with the extruder to secure the extruder to the second end of the receptacle. Both the second end of the receptacle and the retaining ring have retainers that releasably attach the retaining ring and the extruder to the second end of the receptacle.

The modeling compound forming toy is also disclosed in another version as including a mold that functions as the component for forming the modeling compound with the mold secured to the second end of the receptacle. Modeling compound is thus forced into the mold upon operation of the rotary actuator by either the hand crank or electric motor actuation. Retainers on the mold and on the second end of the receptacle are preferably provided for releasably securing the mold to the second end of the receptacle.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
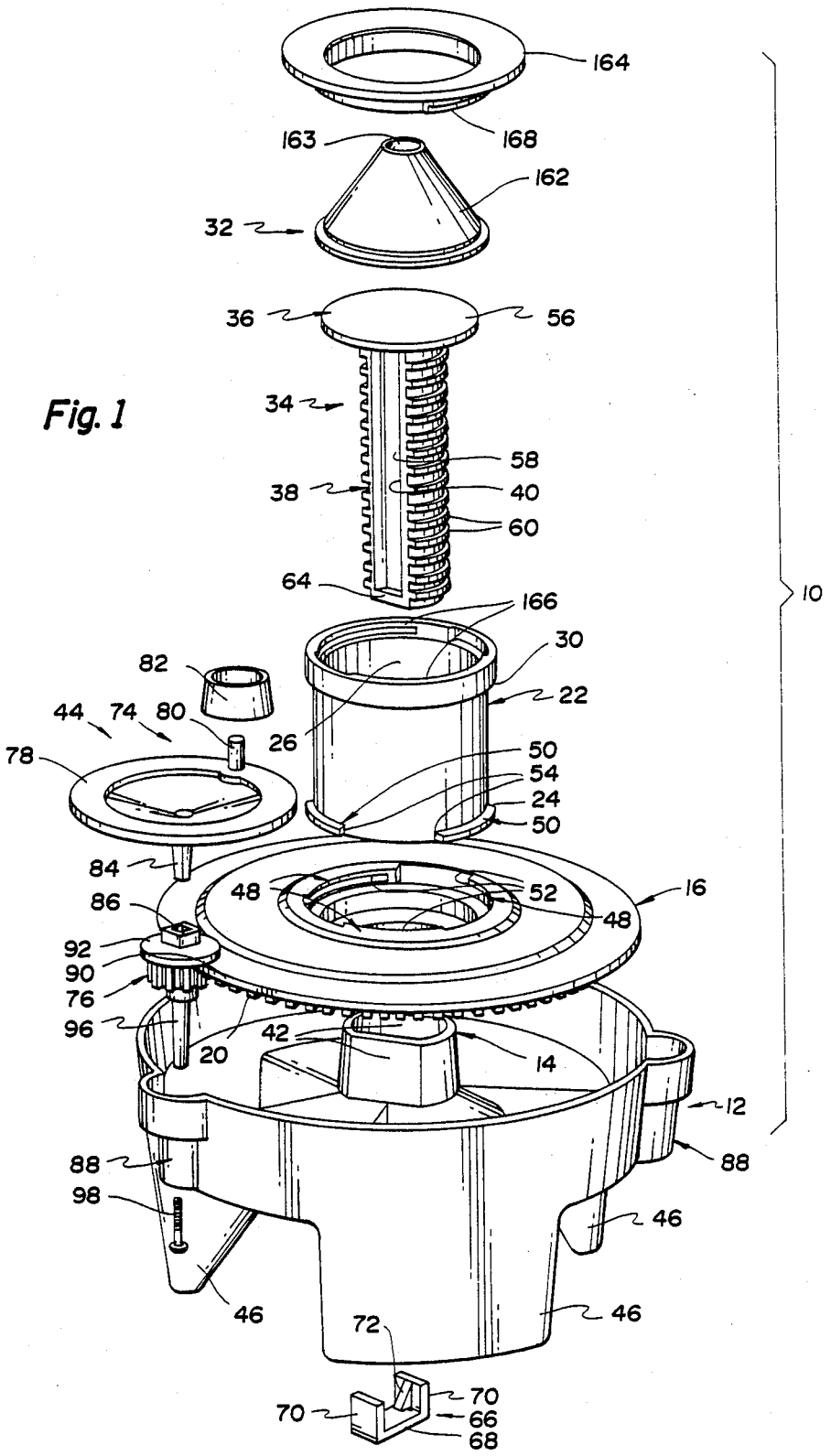
FIG. 1 is an exploded perspective view of one embodiment of a toy for forming modeling compound in accordance with this invention by operation of a hand crank of a rotary actuator which provides screw actuated forming by an extruder that is illustrated as being utilized with the toy.
Figure 3:
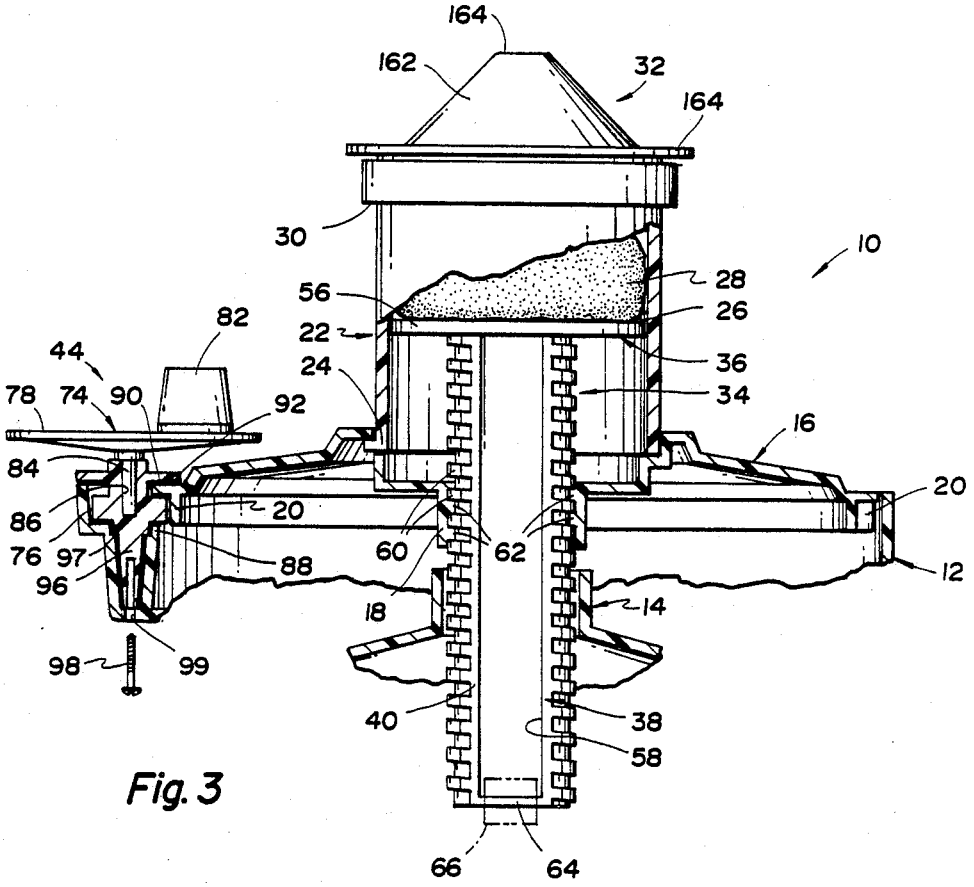
FIG. 3 is an elevational view taken partially in section with the toy of FIG. 1 assembled.

With reference to FIG. 1 of the drawings, a modeling compound forming toy constructed in accordance with the present invention is generally indicated by 10 and includes a base 12 having a central ram slide 14. A turntable 16 of the toy is rotatably supported on the base 12 and has a central threaded portion 18 that is aligned with the ram slide 14 of the base 12 as shown in FIG. 3. The turntable 16 also has a peripheral drive gear 20 that is illustrated in both FIGS. 1 and 3 and has a ring shape for providing rotational driving of the turntable as is hereinafter more fully described.

A receptacle 22 of the toy has a first end 24 for providing mounting thereof on the turntable 16 and has a hollow interior 26 for receiving modeling compound 28 to be formed as shown in FIG. 3. This receptacle 22 also has a second end 30 for supporting a component 32 for forming the modeling compound.

A ram member 34 of the toy has a ram 36 and a threaded slide rod 38 projecting from the ram. As shown in FIG. 3, the assembled toy has the ram 36 received within the hollow interior 26 of the receptacle 22. The threaded slide rod 38 of the ram member 34 is slidably received within the central ram slide 14 of the base 12 with flat portions 40 and 42 of the slide rod and ram slide shown in FIG. 1 preventing rotation thereof during the sliding movement. Above the central ram slide 14 of the base, the threaded slide rod 38 is threaded through the central threaded portion 18 of the turntable 16 as shown in FIG. 3.

A rotary actuator 44 of the toy drives the drive gear 20 of turntable 16 to provide rotation thereof and screw actuated movement of the ram member 34 in an upward direction so as to force the modeling compound out of the receptacle for forming of the modeling compound by the component 32 as is hereinafter more fully described.

It should be appreciated that the mechanical advantage achieved by the construction of the toy 10 as described above permits children to provide forming of modeling compound even when significant force is necessary due to the resistance of the modeling compound to deformation. As is hereinafter described, this forming can be performed either as an extrusion or as a molding operation depending upon the type of forming component 32 utilized.

In the preferred construction, the modeling compound forming toy 10 has its base 12, turntable 16, receptacle 22, and ram member 34 made as plastic injection moldings. More specifically, the base 12 has an upwardly opening shape as shown in FIG. 1 and includes three hollow, downwardly projecting legs 46 that are equally spaced circumferentially with respect to each other about the central ram slide 14. The plastic injection molded turntable 16 and the receptacle 22 are illustrated as being made separate from each other and have retainers 48 and 50 that permit securement of the receptacle to the turntable. While it would be possible to manufacture the turntable 16 and receptacle 22 unitary with each other, the separate construction illustrated is advantageous from both a manufacturing and packaging standpoint. In order to secure the turntable 16 and receptacle 22 to each other, the retainers 48 and 50 are preferably constructed as arcuate tabs 52 and 54 that are engaged by axial movement therebetween and rotation of the receptacle relative to the turntable. As illustrated, three associated sets of the arcuate tabs 52 and 54 are provided located circumferentially from each other in an equally spaced relationship. Also, the plastic injection molded receptacle 22 has a round cross section between its ends 24 and 30.

As shown in both FIGS. 1 and 3, the plastic injection molded ram member 34 has its ram 36 shaped as a round disc 56 from which the threaded slide rod 38 projects at a central location. The flat portions 40 of the slide rod 38 are oriented in oppositely facing directions parallel to each other and each defines a depression 58 of a vertically elongated configuration. Between its flat portions 40, the slide rod 38 has threads 60 that are threaded with threads 62 of the central threaded portion 18 of base 12 as shown in FIG. 3. The threaded slide rod 38 has a distal locking end 64 remote from the disc-shaped ram as shown in both FIGS. 1 and 3. A plastic injection molded locking clip 66 best illustrated in FIG. 1 has a base 68 from which a pair of legs 70 project. Each leg 70 has a locking tang 72 that is snapped into one of the depressions 58 of the slide rod 38 at its locking end 64. This locking clip engages the lower side of the base ram slide 14 so as to limit the screw actuated upward movement of the ram member 34 and hence maintains the assembled relationship of the toy.

The embodiment of the rotary actuator 44 illustrated in FIGS. 1 and 3 includes a rotary hand crank 74 and a pinion gear 76 that is rotated by the hand crank. The rotary hand crank 74 includes a plastic injection molded wheel 78 having an upwardly projecting stub shaft 80 that receives a knob 82 for rotating the crank. A downwardly projecting central projection 84 of the wheel 78 has a tapered square cross section and is received within a complementary hole 86 in the pinion gear 76 which is also injection molded from plastic. A bearing 88 of the base 12 is shown in FIG. 3 and rotatably supports the pinion gear 76 in meshing engagement with the peripheral drive gear 20 of the turntable 16. Rotation of the hand crank 74 thus rotates the pinion gear 76 to rotatively drive the peripheral drive gear 20 of turntable 16 with a mechanical advantage that provides the screw actuated movement of the ram member 34 for the forming of the modeling compound as previously described.

Base 12 of the toy has three of the bearings 88 spaced angularly at 120 degree centers from each other. Above the drive gear 20, the turntable 16 includes an annular flange 90 that is received between the pinion gear 76 and an upper flange 92 molded unitary with the pinion gear so as to maintain the meshing relationship of the pinion gear 76 and the turntable drive gear 20.

As shown in FIG. 3, the pinion gear 76 includes a central pin 96 and the bearing 88 includes an annular bearing ring 97 on this pin for providing the rotational support shaft. Also, a screw 98 extends through a hole 99 in the base into gear pin 96 to cooperate with the other structure of the bearing in rotatably supporting the pinion gear in meshing engagement with the drive gear of the turntable.

Figure 4:
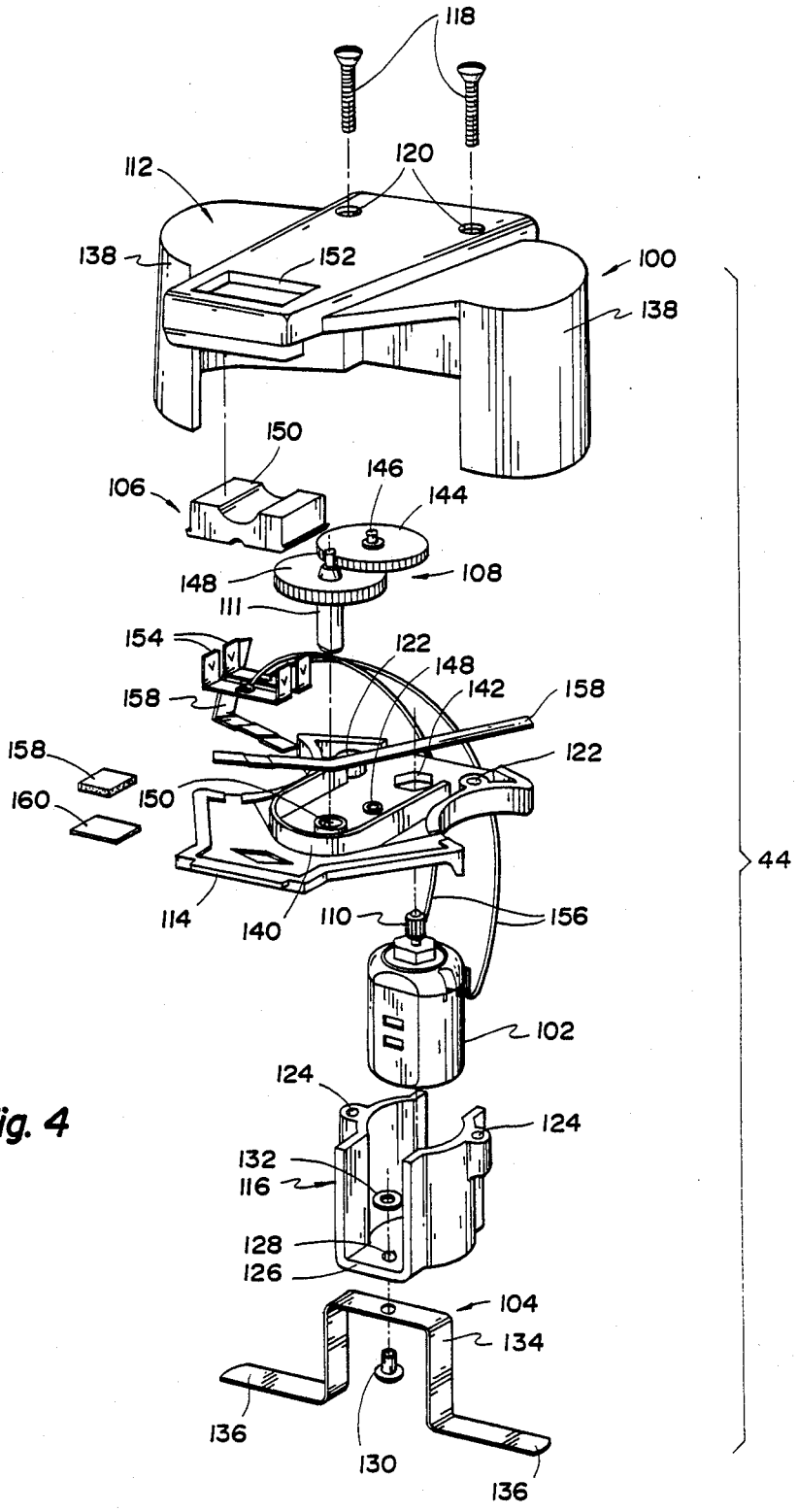
FIG. 4 is an exploded perspective view of another embodiment of the rotary actuator which utilizes an electric motor for providing screw actuated forming of the modeling compound.

With reference to FIG. 4, another embodiment of the rotary actuator is power operated and includes a housing 100, an electric motor 102 supported by the housing, a battery clip assembly 104 for supporting at least one and preferably a pair of unshown batteries for energizing the motor, a switch 106 for controlling the motor operation, and a gear drivetrain 108 having an input embodied by a gear 110 driven by the motor and an output embodied by a projection 111 that drives the pinion gear 76 which drives the peripheral drive gear of the toy turntable as previously described.

In the preferred construction, the power operated rotary actuator housing 100 shown in FIG. 4 includes a cover 112 that opens downwardly and a chassis 114 that closes the lower extremity of the housing as well as including a motor mount 116. The cover 112, chassis 114, and motor mount 116 are each preferably made as a separate plastic injection molding. A pair of screws 118 are threaded through holes 120 in the housing 112, holes 122 in the chassis 114, and into holes 124 in the motor mount 116 to secure the cover and chassis of the housing and the motor mount to each other. In this assembled relationship, the motor mount 116 depends downwardly from the chassis 114 with its upwardly opening shape receiving the motor 102. The motor mount 116 has a base wall 126 having a hole 128 for receiving a rivet 130 whose retainer 132 cooperates with the rivet to secure a battery clip 134 of the battery clip assembly 104. This clip 134 has a pair of legs 136 for securing a pair of unshown batteries within opposite ends 138 of the cover housing 112.

The housing chassis 114 as shown in FIG. 4 has a drivetrain wall 140 of a U-shaped configuration for receiving the gear drivetrain 108. Specifically, the input gear 110 extends upwardly through an opening 142 in the chassis 114 adjacent the ends of the U-shaped wall 140 and drives an intermediate gear 144 whose support pin 146 is received within a hole 148 in the chassis. At its lower side, the intermediate gear 144 supports an unshown drive gear that drives a gear 148 whose lower side supports the tapered output projection 111 which has a square cross section for driving the pinion gear 76 by insertion thereof within its hole 86 as previously described in connection with the hand crank operated embodiment of FIG. 1. This tapered projection extends through a round opening 150 in the chassis 114 so as to be positioned below the chassis to provide the pinion gear driving of the toy as previously described.

With continuing reference to FIG. 4, the power operated rotary actuator 44 has its switch 106 provided with an operation button 150 that projects upwardly through a hole 152 in the housing cover 112 in the assembled position. A pair of switch contacts 154 connected by wires 156 to the motor 102 are positioned between the button 150 and the housing chassis 114 and are associated with a pair of battery contacts 158 whose outer ends are connected to the pair of batteries positioned by the clip assembly 104. A switch return foam pad 158 and a piece of two faced insulator tape 160 cooperate to provide a switch return that normally positions the switch in off position while permitting switch contact and consequent motor operation in one direction or the other depending upon which end of the button 150 is pushed.

With reference to FIG. 1, the forming component 32 is illustrated as being an extruder 162 for forming the modeling compound upon the screw actuated movement of the ram member 134 as previously described. This extruder 162 includes an opening 163 that is illustrated as being round. However, other opening shapes can also be utilized such as a star shape, an H shape, etc. to provide extrusion of modeling compound for child play. A retaining ring 164 provides a preferred means for securing the extruder 162 to the second end 30 of the modeling compound receptacle 22. This second receptacle end 30 and the retaining ring have retainers 166 and 168 that releasably attach the retaining ring and hence the extruder to the second end of the receptacle. Specifically, there are a pair of each of the retainers 166 and 168 located at diametrically opposite locations such that axial downward movement of the retaining ring 164 from above the extruder 162 provides the securement upon subsequent rotation with the retainers into an interlocked relationship with each other.

Figure 2:
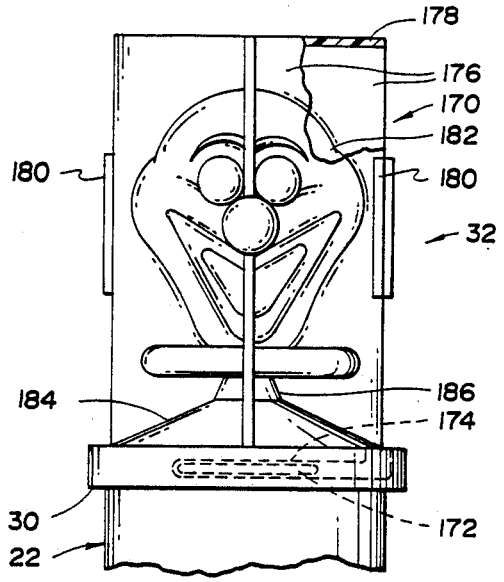
FIG. 2 is an elevational view that illustrates a mold that is also usable with the toy to provide forming of the modeling compound by molding.

As illustrated in FIG. 2, it is also possible for the forming component 32 to be embodied by a mold 170 for molding the modeling compound during operation of the toy as previously described. This mold secured to the second end 30 of the receptacle 22, preferably by retainers 172 and 174 on the mold and on the second end of the receptacle. Mold 170 has a unitary construction including a pair of mold portions 176 that are connected by a unitary hinge 178 for pivoting opening and closing movement about its upper end. Such pivoting opens the mold to remove the molded articles and closes the mold for securement by a pair of unitary latches 180 that snap into position to hold the mold closed such that the mold portions define a mold cavity 182. As illustrated, the mold cavity 182 provides a clown shape, but it is also possible to provide other configurations such as animals, or whatever other shape is desired. During the molding, the modeling compound is forced upwardly through a tapered section 184 of the mold through a mold opening section 186 into the mold cavity 182 to the shape of the cavity. Thereafter, the mold is opened as previously described after first releasing the latches 180.

While the best modes for carrying out the invention have been described in detail, those familiar with the art to which this invention relates will recognize various alternative designs and embodiments for carrying out the invention as described by the following claims.

What is claimed is:

1. A modeling compound forming toy comprising:

a base having a central ram slide;

a turntable rotatably supported on the base, the turntable having a central threaded portion aligned with the ram slide of the base, and the turntable also having a peripheral drive gear;

a receptacle having a first end for providing mounting thereof on the turntable, the receptacle having a hollow interior for receiving modeling compound to be formed, and the receptacle having a second end for supporting a component for forming the modeling compound;

a ram member having a ram and a threaded slide rod projecting from the ram, the ram being received within the receptacle, and the threaded slide rod being slidably received by the central ram slide of the base and threaded through the central threaded portion of the turntable; and a rotary actuator for driving the drive gear of the turntable to provide rotation thereof and screw actuated movement of the ram member that forces the modeling compound out of the receptacle for forming of the modeling compound.

2. A modeling compound forming toy as in claim 1 wherein the base, the turntable, the receptacle, and the ram member are plastic injection moldings.

3. A modeling compound forming toy as in claim 2 wherein the plastic injection molded turntable and receptacle are made separate from each other and have retainers that permit securement of the receptacle to the turntable.

4. A modeling compound forming toy as in claim 3 wherein the retainers comprise arcuate tabs that are engaged by rotation of the receptacle relative to the turntable.

5. A modeling compound forming toy as in claim 2 wherein the injection molded ram member has its ram shaped as a round disc from which the threaded slide rod projects at a central location, the threaded slide rod having a distal locking end remote from the ram, and a locking clip that is locked to the locking end of the threaded slide rod.

6. A modeling compound forming toy as in claim 1 or 2 wherein the rotary actuator includes a rotary hand crank and a pinion gear rotated by the hand crank, the base having a bearing for rotatably supporting the pinion gear, and the pinion gear being meshed with the peripheral drive gear of the turntable to provide rotation thereof upon manually actuated rotation of the rotary hand crank.

7. A modeling compound forming toy as in claim 6 wherein the pinion gear of the rotary actuator includes a central pin and the bearing includes an annular bearing ring on the base for receiving the pin so as to provide rotatable support of the pinion gear in meshing engagement with the drive gear of the turntable.

8. A modeling compound forming toy as in claim 1 or 2 wherein the rotary actuator includes: a housing, an electric motor supported by the housing, a battery clip assembly for supporting at least one battery for energizing the motor, a switch for controlling the motor operation, and a gear drivetrain having an input driven by the motor and an output that drives the peripheral drive gear of the turntable.

9. A modeling compound forming toy as in claim 8 wherein the housing of the rotary actuator includes a cover and a chassis, the rotary actuator also including a motor mount that supports the electric motor, the cover and chassis of the housing and the motor mount each being a separate plastic injection molding, and a pair of screws that secure the cover and chassis of the housing and the motor mount to each other.

10. A modeling compound forming toy as in claim 1 further including an extruder that functions as the component for forming the modeling compound, means for securing the extruder to the second end of the receptacle, and the extruder having an opening through which the modeling compound is extruded upon operation of the rotary actuator.

11. A modeling compound forming toy as in claim 10 wherein the securing means comprises a retaining ring, and the second end of the receptacle and the retaining ring having retainers that releasably attach the retaining ring and the extruder to the second end of the receptacle.

12. A modeling compound forming toy as in claim 1 further including a mold that functions as the component for forming the modeling compound, and means for securing the mold to the second end of the receptacle such that modeling compound is forced into the mold by operation of the rotary actuator.

13. A modeling compound forming toy as in claim 12 wherein the securing means comprises retainers on the mold and on the second end of the receptacle for releasably securing the mold to the second end of the receptacle.

* * * * *